United States Patent [19]

Owens et al.

[11] 4,037,148

[45] July 19, 1977

[54] BALLAST CONTROL DEVICE

[75] Inventors: Michael Owens; Wayne Ray Neal, both of Hendersonville, N.C.

[73] Assignee: General Electric Company, New York, N.Y.

[21] Appl. No.: 605,027

[22] Filed: Aug. 15, 1975

[51] Int. Cl.[2] ..... G05F 1/66

[52] U.S. Cl. ..... 323/17; 315/194; 315/276; 323/24; 323/34; 323/45

[58] Field of Search ..... 307/252 B, 252 N; 315/194, 276, 278, 291; 323/6, 17, 22 SC, 24, 34, 45, 62

[56] References Cited

U.S. PATENT DOCUMENTS

| | | | |
|---|---|---|---|
| 3,532,855 | 10/1970 | Cleave | 323/24 X |
| 3,684,919 | 8/1972 | Cramer | 323/24 X |
| 3,733,528 | 5/1973 | Gilbreath | 323/24 X |
| 3,784,881 | 1/1974 | Horn et al. | 307/252 B |
| 3,873,910 | 3/1975 | Willis | 323/6 |

*Primary Examiner*—A. D. Pellinen

*Attorney, Agent, or Firm*—Sidney Greenberg

[57] ABSTRACT

Ballast control circuit for regulating power supply to high intensity discharge lamp by compensating for changes in line voltage and lamp voltage. Current flowing in power supply to lamp is controlled by a circuit including a triac inductively coupled to the supply line, a triggering circuit for firing the triac at predetermined time intervals for phase control of the alternating current supply to the lamp, a non-linear amplifier circuit for controlling the phase interval of firing of the triac, a synchronizing circuit for synchronizing the triac firing with the lamp voltage, and a voltage reference circuit for controlling the operation of the non-linear amplifier circuit in response to changes in the lamp voltage. A power supply circuit is connected to the alternating current supply for supplying direct current with both regulated and unregulated voltage to the above-described control circuit. The circuit operates to automatically provide constant power to the lamp to maintain desired lamp brightness even with changes in lamp voltage and varying line voltage.

4 Claims, 8 Drawing Figures

BALLAST CONTROL DEVICE

The present invention relates to control circuits for operating load devices, and more particularly concerns alternating current phase controlled circuits which employ control circuits for regulating the operation of high intensity discharge lamps.

It is an object of the invention to provide a flexible and versatile control circuit of the above type which is suitable for operating a wide variety of load devices, and particularly various types of lamps including high intensity discharge lamps of different types, as well as incandescent lamps.

It is a particular object of the invention to provide a control circuit of the above type which regulates power to a high intensity lamp load to compensate for variations in lamp voltage and line voltage.

It is another particular object of the invention to provide a control circuit of the above type which produces constant lumen output throughout the operational life of a high intensity discharge lamp.

Still another object of the invention is to provide a circuit of the above type wherein provision is made for programmed lamp starting current to enhance lamp life.

Other objects and advantages will become apparent from the following description and the appended claims.

With the above objects in view, the present invention in one of its aspects relates to a ballast control circuit comprising, in combination, a source of alternating current, variable impedance means connected in series with the alternating current source, a load connected in series with the alternating current source and the variable impedance means, switch means connected to the variable impedance means and operable at a predetermined phase interval for controlling current through the variable impedance means and thereby controlling power to the load, actuating means connected to the switch means for turning on the switch means, control means connected to the actuating means for controlling the phase interval of operation of the switch means, synchronizing means connected to the actuating means for re-starting the phase interval at zero load voltage, voltage reference means connected to the control means and responsive to the load voltage for controlling the operation of the control means, and voltage regulated direct current supply means connected to the alternating current supply means for providing direct current to the switch means, actuating means, control means and synchronizing means.

The invention will be better understood from the following description taken in conjunction with the accompanying drawings in which.

GENERAL DESCRIPTION

Figure 1:
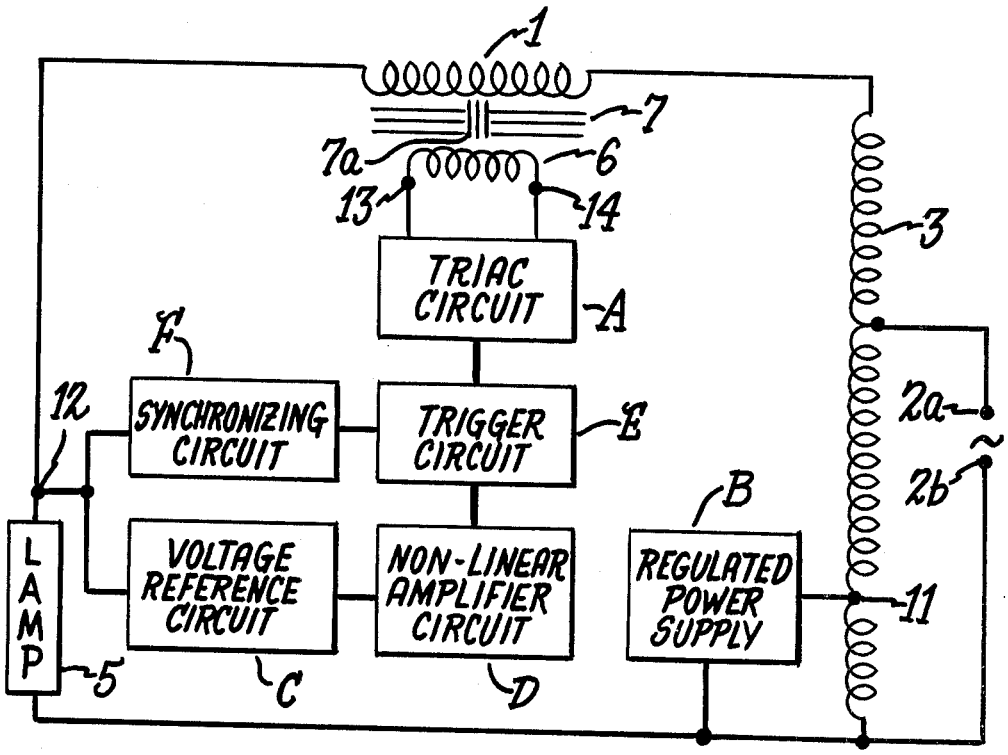
FIG. 1 is a schematic block diagram showing the arrangement of components of a lamp operating and control circuit embodying the invention.

Referring to the block diagram of FIG. 1, the circuit of the invention comprises a variable inductive ballast reactor comprising a main winding 1 connected at one side by an autotransformer 3 to terminal 2*a* of a source of alternating current. At its other side main winding 1 is connected in series with lamp 5, which is typically a mercury vapor, sodium vapor or other type of high intensity discharge (HID) lamp. Lamp 5 is connected at its other side to terminal 2*b* of the alternating current supply. Control winding 6 is arranged inductively coupled to main winding 1, the winding being typically wound on magnetic core 7 on opposite sides of magnetic shunt 7*a*. Triac circuit A includes a triac semiconductor switch connected in series with control winding 6. Firing of the triac switch operates to control the current flowing through the main winding 1 and thereby control the wattage (power) to lamp 5. The structure, function, and operation of this ballast control device are more fully described in the U.S. Patent to Willis No. 3,873,910, issued Mar. 25, 1975 and assigned to the same assignee as the present invention, and the disclosure thereof is accordingly incorporated herein by reference.

In accordance with the present invention, the triac in circuit A is fired at a predetermined interval in the alternating current cycle to automatically compensate for variation in line voltage and lamp voltage during the operational life of the lamp, and thereby to provide constant wattage to the lamp to maintain its light output at the desired level. For this purpose, there are provided in the circuit, as seen generally in FIG. 1, a power supply circuit B connected to autotransformer 3 for providing a voltage regulated direct current supply, a trigger circuit E for firing the triac in circuit A at a predetermined phase interval as more fully explained below, a non-linear (differential) amplifier circuit D connected to trigger circuit E for controlling the phase interval at which the triac is fired, a synchronizing circuit F connected between lamp 5 and trigger circuit E for re-starting the phase interval at zero lamp voltage for firing the triac, and a voltage reference circuit C connected between lamp 5 and non-linear amplifier circuit D for controlling the operation of the latter circuit in response to the lamp voltage. In the operation of these circuits, power supply circuit B provides a positive regulated d-c voltage to the non-linear amplifier, trigger and synchronizing circuits and also provides a positive unregulated d-c voltage to the non-linear amplifier and trigger circuits. The input of power supply circuit B is connected to tap 11 on autotransformer 3 to obtain a low voltage supply, e.g., about 17 volts.

DETAILED DESCRIPTION

Each of the above-mentioned circuits shown in the block diagram of FIG. 1 is depicted in a preferred detailed circuit of the invention shown in FIG. 2, and is explained in the following descriptions of the component circuits.

TRIAC CIRCUIT A

In triac circuit A, triac Q2 is connected at terminals 13 and 14 in series with control winding 6 (see FIG. 1), and resistor R17 connected in series with capacitor C6 is connected across triac Q2 to serve as a snubber circuit. When triac Q2 is fired by operation of trigger circuit E, it shorts secondary winding 6 of the control reactor, changing the impedance of main winding 1 of the reactor in the manner as indicated previously. Current flows through Q2 for some portion of the half-cycle of a-c lamp current, but when the current through Q2 goes to zero, the inductance of control winding 6 tends to produce a very rapid rise in voltage across the triac. The series combination of resistor R17 and capacitor C6 slows the rate of rise of voltage (*dv/dt*), allowing the use of the triac across the inductive winding 6.

POWER SUPPLY B

In this circuit, resistor R24 and diode D7 are connected in series to the low voltage tap 11. D7 rectifies the a-c wave form while R24 limits the input current. Capacitor C9 is a d-c filter storage capacitor and serves to filter the rectified a-c wave form. The network comprising diode D8 and capacitor C8 provides a low-ripple unregulated d-c potential.

The voltage on capacitor C9 is applied to input terminals 2,3 of Q5, which is an operational amplifier for d-c voltage regulation. The output of Q5 at terminal 8 is an adjustable d-c regulated potential. Connected to terminal 6 of Q5 is the voltage adjust feedback reference constituted by the network comprising resistor R27 and potentiometer R26. Connected across R26 and R27 as shown is the output filter capacitor C10. Connected from output terminal 8 to terminal 1 of Q5 is resistor R25 which provides current limiting of the output under short circuit conditions. As will be evident, positive unregulated d-c voltage is obtained at the output of C8 for applying to the trigger and non-linear amplifier circuits, and positive regulated d-c voltage is obtained at terminal 8 of Q5 for applying to the other circuits, as more fully described below.

VOLTAGE REFERENCE CIRCUIT C

This circuit includes resistors R1 and R2 connected to lamp 5 via terminal 12 and serving as a voltage divider network to lower the lamp voltage. The a-c lamp voltage present at terminal 12 is applied across the series connected R1 and R2, the a-c voltage being divided by the ratio R2/(R1 + R2) and applied to diode D1 for rectification. During the starting interval of certain HID lamps, a high voltage pulse, e.g., in the kilovolt range, may be present at terminal 12. In order to prevent damage to solid stage components in the circuit, a high frequency bypass capacitor C1 is connected in parallel with R2. Capacitor C2 filters the rectified a-c signal and yields a negative d-c voltage proportional to the magnitude of the a-c lamp voltage.

NON-LINEAR AMPLIFIER CIRCUIT D

Figure 3:
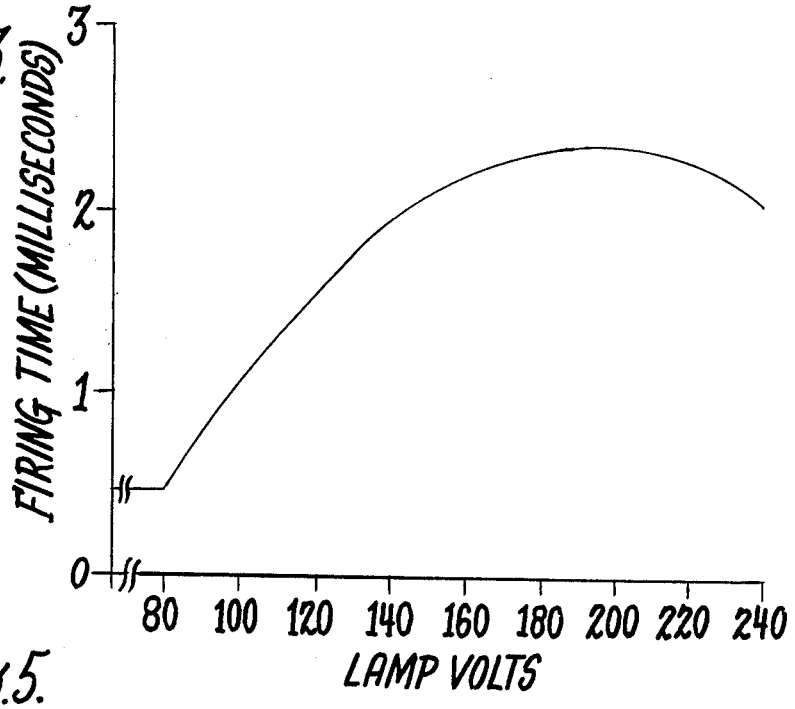
FIG. 3 is a graph showing the relation of triac firing time to lamp voltage at nominal line voltage.

This circuit serves to match the current in the lamp supply line to the lamp voltage to produce a constant wattage in the lamp load. FIG. 3 is a graphical representation of a typical curve obtained by plotting the firing time of the triac which is necessary in relation to the lamp volts of a 400 watt HID lamp in order to maintain constant wattage of the lamp. As known by those versed in the art, high pressure sodium vapor lamps usually vary in voltage over their operational life, and it therefore becomes necessary to correspondingly adjust the triac firing time in the manner indicated by the curve in FIG. 3 in order to achieve constant lamp wattage. Non-linear amplifier circuit D described below automatically adjusts the triac firing time for this purpose.

Figure 5:
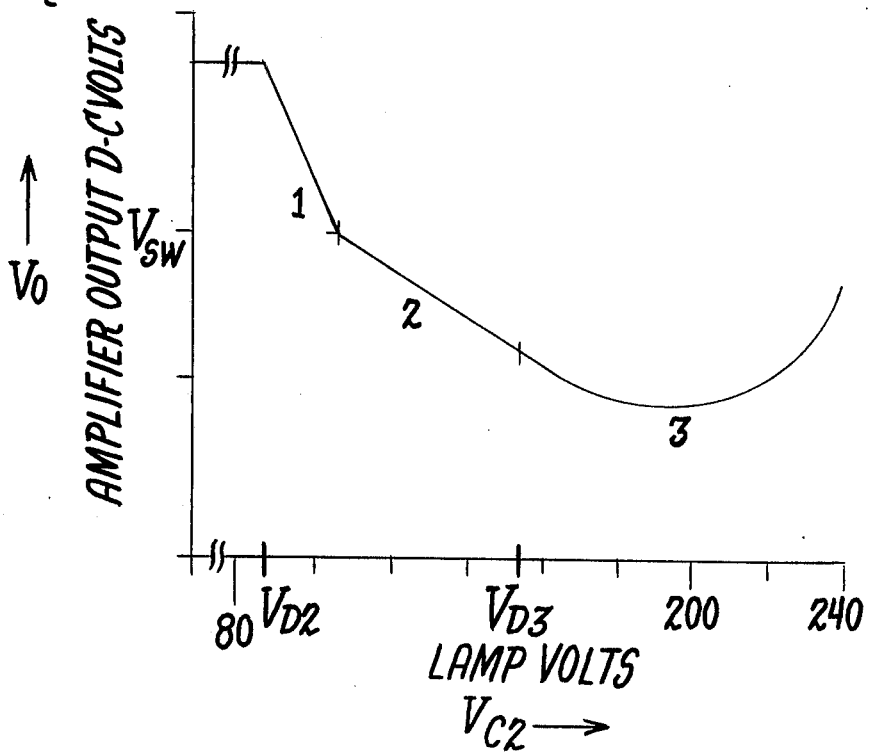
FIG. 5 is a graph showing the relation of the non-linear amplifier output in d-c volts to lamp voltage.

FIG. 5 is a graph in which the amplifier circuit output in d-c volts ($V_o$) is plotted against the lamp volts and the voltage of capacitor C2 which is proportional thereto. Amplifier circuit D operates, as more fully described below, to produce a curve as shown in FIG. 5 characterizing the amplifier output which is necessary to compensate for lamp voltage variation to obtain constant lamp wattage. As $V_o$ increases in a positive direction, the triac firing time becomes shorter, hence more current is delivered to the lamp, whereas less current is delivered when $V_o$ decreases to delay the firing time, as more fully explained below.

Figure 4:
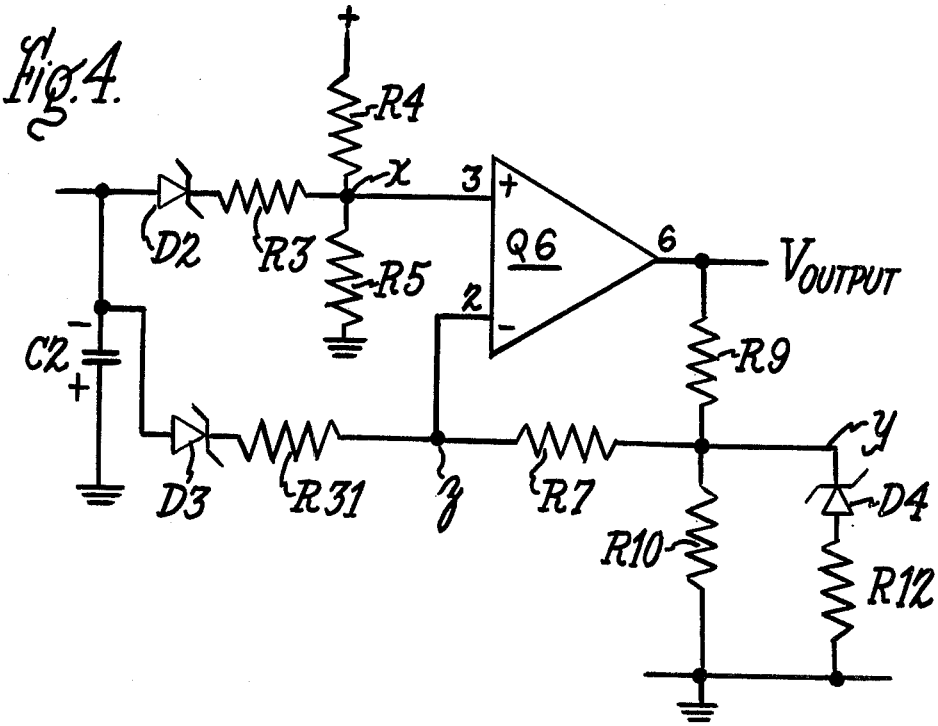
FIG. 4 is a circuit diagram of a portion of the non-linear amplifier circuit shown in FIG. 2.
Figure 2:
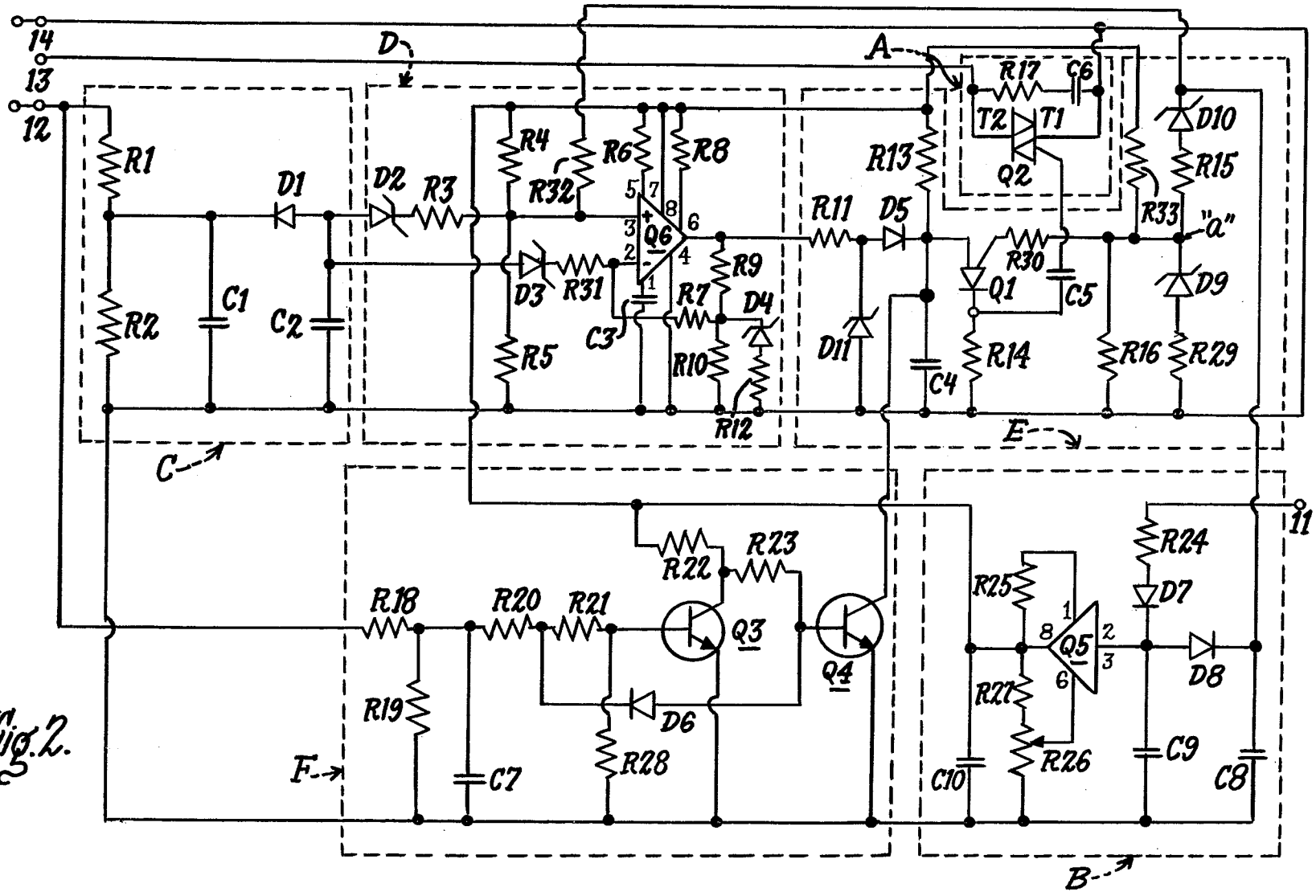
FIG. 2 is a detailed circuit diagram of the control circuit in accordance with an embodiment of the invention.

In this circuit, amplifier element Q6, which is typically a transconductance amplifier such as that produced by RCA under the designation CA 3094 is employed, along with a bias resistor R6, high frequency bypass capacitor C3 and collector limiting resistor R8 connected to amplifier Q6 as shown in FIG. 2. Resistors R3, R4 and R5 form a voltage divider network for input voltage control. Resistors R9 and R10 serve as feedback gain control resistors, as do resistors R31 and R7 as explained below. With reference particularly to FIG. 4 showing the amplifier portion of the circuit, the negative d-c voltage on capacitor C2 is applied to Zener diode D2, which has a conduction voltage of $V_{D2}$ (about 43 volts), and through R3 to a summing junction point *x*. The voltage at point *x* when the magnitude of $V_{C2}$ is below $V_{D2}$ is $$\frac{R5(+\text{reg.})}{R4 + R5},$$

where "+reg." refers to positive regulated voltage. This voltage is applied to a non-inverting amplifier which has a gain described as follows. When $V_o$ is such that the voltage at the junction of R9 and R10 is above the breakdown voltage of Zener diode D4 ($V_{D4}$), then the gain of the amplifier is described by the following equation and is characterized by the slope of section 1 in the FIG. 5 curve:

$$V_o = V_x \left(1 + \frac{R9}{R10 // R12}\right) \quad (1)$$

where "//" means "in parallel with". As the input voltage $V_{C2}$, which is proportional to lamp voltage, increases to a value above $V_{D2}$, then the voltage at point *x* begins to decrease because $V_{C2}$ is a negative voltage summing with the positive potential $$\frac{(+\text{reg.})R5}{R4 + R5}.$$

$V_o$ remains at a constant level until $V_{C2}$ equals $V_{D2}$, then $V_o$ decreases with a gain as shown in equation (1) above.

$$\text{When } V_o = V_{D4}\frac{[R9+(R10 // R12)]}{R10 // R12} = V_{sw}$$

where $V_{sw}$ refers to switching voltage (see FIG. 5), then the voltage at the junction of R9 and R10 drops below that necessary for conduction of Zener diode D4 ($V_{D4}$), and the gain of the amplifier stage changes to that described by the following equation and characterized by slope section 2 in FIG. 5:

$$V_o = V_x\left(1+\frac{R9}{R10}\right)$$

As the lamp voltage continues to climb, $V_o$ decreases until such time as $V_{C2}$ reaches a value equal to the Zener diode voltage $V_{D3}$. At this time, the negative voltage, which is proportional to lamp voltage, is now applied through resistor R31 to the inverting input of amplifier Q6. Now the feedback voltage at point *z* is the sum of $V_{C2}$ - $V_{D3}$ through R31, and the voltage $V_y$ through R7. By applying a negative voltage to the input terminal 2 of Q6, the output of Q6 tends to go more positive. Therefore, the output of this amplifier stage has been modified from that of slope section 2 to slope section 3 as seen in the curve of FIG. 5.

The overall effect of this output characteristic is to provide high positive voltage when the lamp is at low voltage (see FIGS. 3 and 5) thereby applying a high positive potential to the trigger circuit, yielding a short firing time $T_1-T_3$ (see FIG. 6) and thereby creating a low series impedance between the a-c line and the HID lamp. As the lamp voltage rises, the d-c potential $V_o$ decreases, which in turn makes time $T_1-T_3$ longer, delaying firing of the triac and increasing the series impedance of the variable reactance winding 1, thus maintaining a constant wattage or constant lumen output from the HID lamp. As the voltage of the lamp continues to rise, the impedance of the lamp increases until a maximum power transfer point is reached between line voltage, variable reactance and HID lamp. At this lamp voltage, the variable reactance is at a maximum value or maximum firing time of the trigger circuit and triac Q2. This requires a maximum firing time $T_1-T_3$ and therefore a minimum value of $V_o$ of the amplifier stage. As the lamp voltage continues to increase, the series impedance of the variable reactance must now decrease in order to achieve the desired wattage or lumens in the HID lamp. This means the $T_1-T_3$ firing time must decrease and thus $V_o$ must go more positive until such time as the lamp voltage rises to such a point that it can no longer be sustained with the available a-c line voltage.

As part of the overall correction for the a-c line voltage it is sometimes necessary to apply positive unregulated voltage to the input of the amplifier stage through resistor R32. This corrects for any over-corrosion in the line voltage in the trigger circuit.

TRIGGER CIRCUIT E

Figure 6:
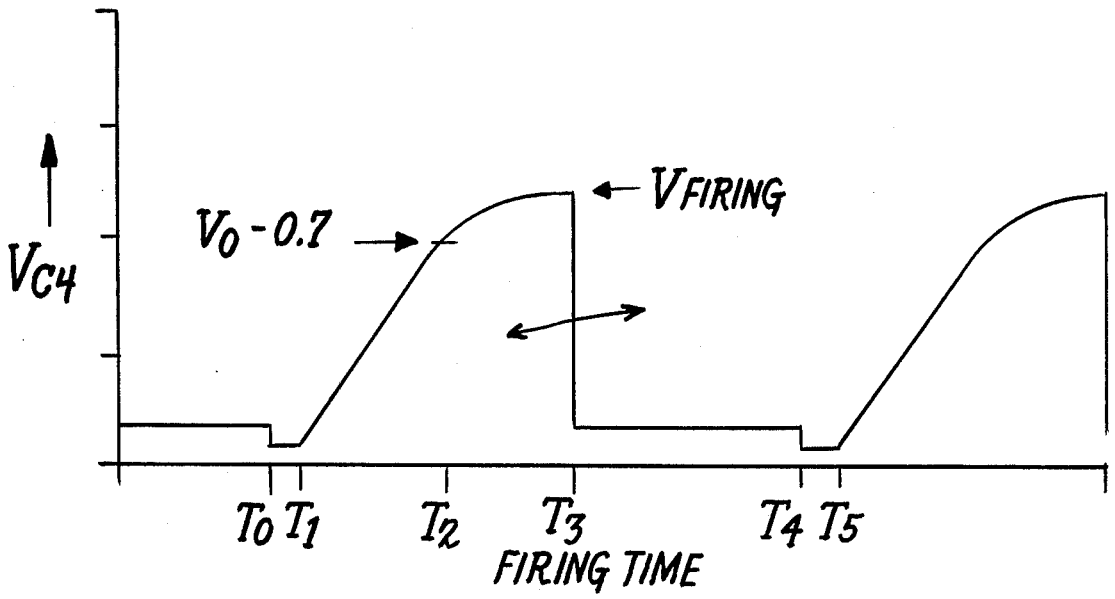
FIG. 6 is a graph showing the wave form representing the voltage of a charging capacitor in the trigger circuit in relation to firing time of the circuit.

In this circuit, as seen in FIG. 2, resistors R13 and R11, capacitor C4 and diode D5 form a charging network which charges C4 to a d-c potential via two paths, the first being from the output of the non-linear amplifier circuit through R11 and D5 to C4, the second being from the positive regulated voltage output of power supply circuit B through R13 to C4. The purpose of the two paths is to provide a fixed charging time for C4 from the positive regulated voltage output with a variable portion being obtained from the non-linear amplifier circuit. A typical wave form produced thereby is shown in the graph of FIG. 6 in which $V_{C4}$ is plotted against triac firing time. At time $T_1$, capacitor C4 begins to charge through both R11 and R13, causing the charge to be very rapid as evidenced by the fast rate of rise of voltage on C4 between $T_1$ and $T_2$. When the voltage on C4 reaches a level equal to the output of the non-linear amplifier ($V_o$) minus 0.7 volts, diode D5 becomes non-conductive and the rate of voltage rise changes because C4 is charging through R13 only. This is seen in FIG. 6 as the portion of the charging curve between $T_2$ and $T_3$. At time $T_3$, the voltage on the anode of programmable unijunction transistor (PUT) (see FIG. 2, Circuit E) has reached a voltage higher than that present on the gate as determined by the associated voltage divider network comprising resistors R15, R16, R29 and R33 and Zener diodes D9 and D10. When Q1 fires, timing capacitor C4 discharges through Q1 and resistor R14 in series therewith, causing a voltage drop across R14. This discharge produces a pulse which is coupled through capacitor C5 to the gate of triac Q2, causing conduction of the triac to begin. The current through resistors R13 and R11 now passes through R14 and creates a holding current for Q1 until the synchronized pulse from synchronizing circuit F clamps the voltage at the anode of Q1 below the holding point, and Q1 becomes non-conducting and C4 begins to charge again when the synchronizing pulse is removed. The firing time of Q1 occurs at reference time $T_3$, while the conduction period of Q1 is the period $T_3$ and $T_4$, and the synchronizing period is $T_4$ to $T_5$. By varying the amplitude of the output voltage from the non-linear amplifier circuit, the total time to firing $T_1$ to $T_3$ can be varied.

Figure 7:
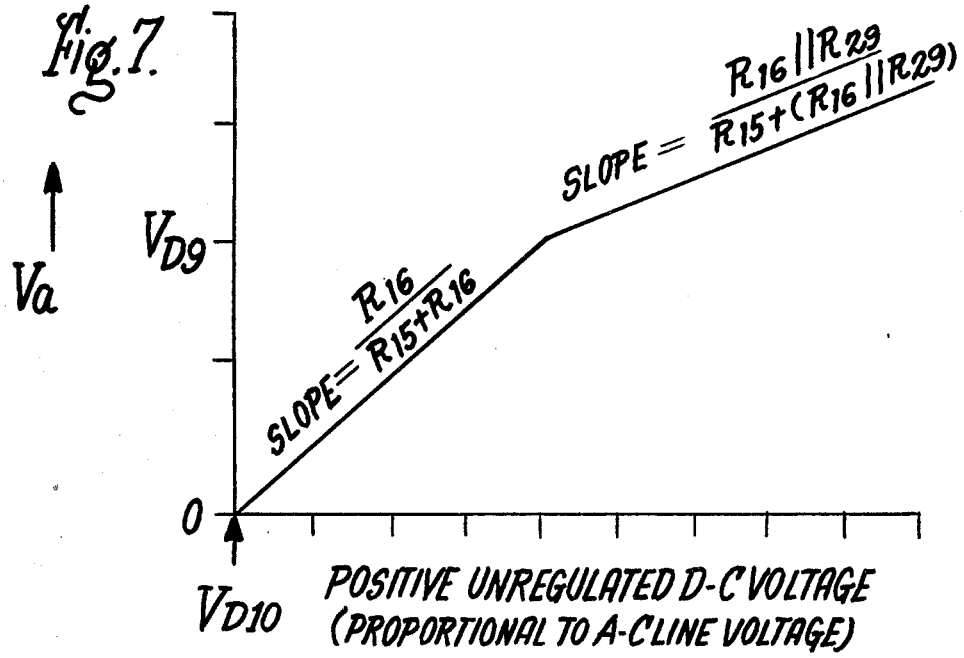
FIG. 7 is a graph illustrating the relationship of voltage at the gate of transistor Q1 of the trigger circuit and the a-c line voltage.

Most line voltage compensation is achieved in the trigger circuit E by controlling V firing or the firing voltage as determined by the gate of Q1. By supplying the gate from the unregulated voltage supply through a voltage divider network, comprising R15, R16, R29, R33, D9 and D10, the desired level of the firing voltage can be obtained. The overall scheme of the divider network is illustrated in FIG. 7, in which the voltage at point *a* ($V_a$), is plotted against the positive unregulated d-c voltage applied to trigger Circuit E, which is proportional to the a-c line voltage. Considering now the network comprising D10, R15, R16, D9 and R29, as the positive unregulated voltage input to the network is increased from zero voltage, there is no output at point *a* until the unregulated voltage equals the breakdown voltage of Zener diode D10, and as the positive unregulated voltage increases, the voltage at point *a*, which is connected to the gate of Q1, can be described by the following equation:

$$V_a = \frac{R16\,(+\text{unreg.} - V_{D10})}{R15 + R16} \qquad (3)$$

were $V_{D10}$ is the forward drop of Zener diode D10. This is a linear function with a slope as represented by the initial slope section shown in the graph of FIG. 7.

When the voltage at point *a* reaches a value equal to the value of the Zener diode voltage of D9 ($V_{D9}$), the slope of the curve change to that described by the equation:

$$V_a = \frac{R16 \,//\, R29\,(+\text{ unreg.} - V_{D10})}{R15 + (R16 \,//\, R29)} \quad (4)$$

where "//" denotes "in parallel with" and "+unreg." means "positive unregulated voltage".

This change in slope better matches the characteristic need for control of the reactance 1 in series with lamp 5 with respect to line voltage. Resistor R33 is provided in the circuit merely to limit the current conducted to the gate of Q1 and aid in the continuation of conduction from anode to cathode after Q1 has fired.

As seen from FIG. 6, by raising the firing voltage of Q1 with an increase in line voltage, the time $T_1$ to $T_3$ for charging capacitor C4 becomes longer, which delays firing of Q1 and therefore triac Q2. When this occurs, the series impedance of variable reactance 1 is increased, thus compensating for the increase in line voltage. When the line voltage decreases, the firing level of Q1 decreases, which in turn reduces time $T_1$ to $T_3$. This causes Q1 and triac Q2 to fire sooner, resulting in a decrease in the series impedance of variable reactance 1, thus compensating for lowering of line voltage.

To provide for a programmed starting current to lamp 5, Zener diode D11 (see FIG. 2) is connected at one side to the junction of R11 and D5 and at the other side to the common ground line to clamp the output of non-linear amplifier Q6 to a maximum voltage, in order to set the minimum charge time of C4, thus setting the maximum starting current to the load.

SYNCHRONIZING CIRCUIT F

This circuit serves as a zero voltage switch which functions to clamp the anode of programmable unijunction transistor Q1 of the trigger circuit to a low voltage in order to render Q1 non-conducting, thereby re-starting the phase interval of operation of the trigger circuit at zero load voltage, so that proper operation and symmetrical firing of triac Q2 are achieved.

The synchronizing circuit, as seen in FIG. 2, comprises switching transistors Q3 and Q4 arranged with the collector of Q4 connected to the anode of Q1, and the collector of Q3 connected to the base of Q4 through resistor R23 which serves to provide pulse symmetry. A current limiting resistor R22 is connected to the collector of Q3 and resistor R20 is connected in series with the base of Q3. Diode D6 is connected to Q3 and Q4 such that its anode is connected at the base of Q4 and its cathode is connected via resistor R21 to the base of Q3, as shown. Resistors R18 and R19 serve as a voltage divider, and capacitor C7 connected across R19 is a high frequency bypass capacitor.

Figure 8:
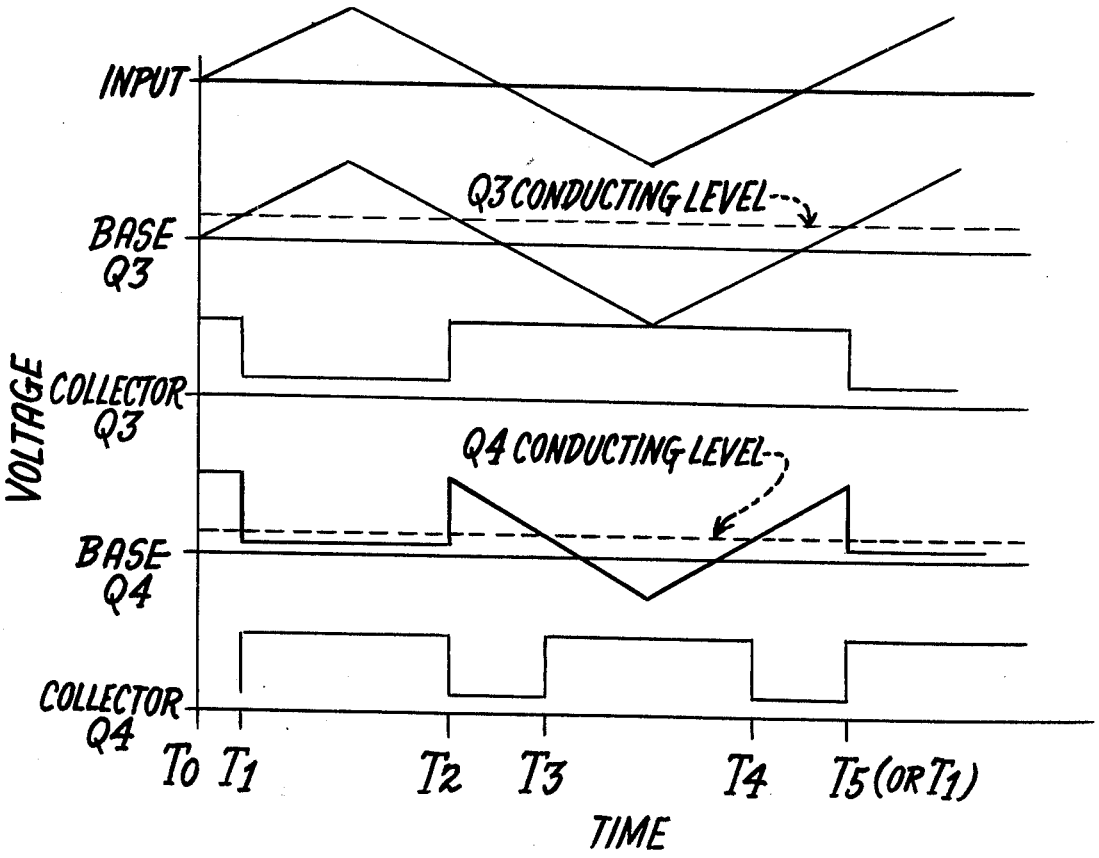
FIG. 8 is a graph showing the characteristic wave forms of the input lamp voltage and the switching transistors in the synchronizing circuit in respect to one another.

In connection with the operation of the synchronizing circuit, reference is made to FIG. 8 showing the relation of voltage of the input lamp wave form and that of the switching transistors in respect to time. At time zero, the input is zero volts at the input of R20 and the voltage at the base of Q3 is below conduction level. Therefore Q3 is non-conducting and the collector of Q3 is at a positive potential above the conduction level established by voltage divider network R22, R23, R21 and R28. This causes Q4 to conduct, clamping the collector of Q4 to a positive level of 0.1 volt or less. As the input voltage level from the lamp load at R20 rises, the voltage at the base of Q3 rises until at time $T_1$ it reaches a level high enough for conduction. This in turn causes the collector of Q3 to drop to 0.1 volt or less. No current can flow through D6 while Q3 is conducting and the a-c input is great enough to cause conduction. Therefore, Q4 remains non-conducting while the collector of Q3 is at a low potential.

At time $T_2$, the a-c input drops below the level required for conduction of Q3, the collector of Q3 goes to its positive state and Q4 becomes conducting, thus discharging C4 through Q4 and clamping the voltage at the anode of Q1 to about zero volts, rendering Q1 non-operative, and the collector potential of Q4 drops to 0.1 volt or less. The base of Q4 is now being biased by the voltage divider network R22, R23, D6, and R20, so that when the input a-c lamp voltage drops to a certain level, the potential at the base of Q4 goes below the conducting level at time $T_3$ and transistor Q4 becomes non-conducting. At this point the charging of C4 begins again. As will be understood, the period between $T_2$ and $T_3$ thus represents the zero voltage synchronization point and thus the re-starting of the phase interval before the triac firing. The input a-c signal continues to hold the base of Q4 non-conducting until time $T_4$, at which time the base of Q4 rises to a sufficiently high potential level at which Q4 becomes conducting. Q4 remains conducting until the input a-c signal reaches the conducting level of Q3, at which time the whole cycle is repeated.

While the invention has been described principally in regard to its application to light sources such as high intensity gaseous dicharge lamps, it may also find application to other types of loads which it is necessary or desirable to operate at constant power, such as heating devices and alternating current motors.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. Ballast control circuit comprising, in combination, a source of alternating current, direct current supply means connected to said alternating current source, variable impedance means connected in series with said alternating current source, a load connected in series with said alternating current source and said variable impedance means, switch means connected to said variable impedance means and operable at a predetermined phase interval for controlling current to said variable impedance means and thereby controlling power to said load, actuating means connected to said switch means for turning on said switch means, control means connected to said actuating means for controlling the phase interval of operation of said switch means and for maintaining constant power to said load with variations in load voltage, synchronizing means connected to said actuating means for re-starting said phase interval at zero load voltage, said actuating means, control means and synchronizing means connected to said direct current supply means, and voltage reference means connected to said control means and responsive to the voltage of said load for controlling the operation of said control means, said control means comprising a non-linear amplifier circuit having decreasing voltage output in response to increasing voltage of said load until a predetermined load voltage is reached, after which the voltage output of said non-linear amplifier circuit increases with increasing load voltage.

2. A circuit as defined in claim 1, said phase interval of operation of said switch means varying inversely as the voltage output of said non-linear amplifier circuit.

3. A circuit as defined in claim 1, said synchronizing means comprising a circuit including first and second switching transistors arranged with the collector of said first transistor connected to the base of said second transistor, a first current limiting resistor connected to said collector of said first transistor, a second resistor connected in series with the base of said first transistor, a third resistor connected between the collector of said first transistor and the base of said second transistor, and a diode connected between the bases of said first and said second transistors, with the anode of said diode being connected to the base of said second transistor and the cathode of said diode connected to the base of said first transistor.

4. A circuit as defined in claim 1, wherein said load is a high intensity gaseous discharge lamp.

* * * * *